US006233794B1

(12) United States Patent
Kohlndorfer et al.

(10) Patent No.: US 6,233,794 B1
(45) Date of Patent: May 22, 2001

(54) BUCKLE FOR USE WITH A PRETENSIONER

(75) Inventors: Kenneth H. Kohlndorfer, Roseville; Carl M. Petersen, III, Waterford; Harjeet Gill, Sterling Heights; Rosemary Longley, Harper Woods; Tammy Korona, Clinton Township, Macomb County; Caryn Foley, Madison Heights; Craig Good, Rochester Hills; Simon X. He, Troy; Tony Jain, Rochester Hills; Lawrence M. Refior, Romeo; Susan A. Richards, Sterling Heights, all of MI (US)

(73) Assignee: Breed Automotive Technology, Inc., Lakeland, FL (US)

( * ) Notice: Subject to any disclaimer, the term of this patent is extended or adjusted under 35 U.S.C. 154(b) by 0 days.

(21) Appl. No.: 09/455,976

(22) Filed: Dec. 6, 1999

Related U.S. Application Data

(63) Continuation-in-part of application No. 09/099,756, filed on Jun. 18, 1998, now Pat. No. 5,996,193.

(51) Int. Cl.[7] ..... A44B 11/26
(52) U.S. Cl. ..... 24/641; 24/633
(58) Field of Search ..... 24/633, 1, 642

(56) References Cited

U.S. PATENT DOCUMENTS 5,704,099 * 1/1998 Cahill .
5,765,266 * 6/1998 Betz .
5,996,193 * 12/1999 Gill et al. .

* cited by examiner

*Primary Examiner*—James R. Brittain
(74) *Attorney, Agent, or Firm*—Markell Seitzman

(57) ABSTRACT

A seat belt buckle (100) operable with a pretensioner (330) comprising: a frame (102) having a first latch opening (126*a*) therein, and opposing frame sides (108*a,b*), each side including a latch plate slot (110) arranged generally perpendicular to the direction of movement of a tongue into the buckle and pivoted weight mechanism (112, 200, 220). The buckle additionally includes a latch plate (180), having portions (186) movable within the latch plate slots between a locked position in engagement with an opening within the tongue and with the first latch opening (126*a*), the latch plate moveable between a latched position within the latch opening (126*a*) in the frame and within the latch opening (173) of the tongue to an unlatched position out of the latch openings. The weight (200) as it pivots generates a force upon the latch plate during operation of the pretensioner tending to keep the latch plate in the first opening and a button (250) operatively received upon the frame having ramp means (260) for lifting the latch plate to its unlatched position.

14 Claims, 11 Drawing Sheets

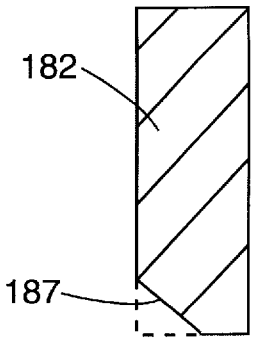
Fig. 4a
Fig. 4b
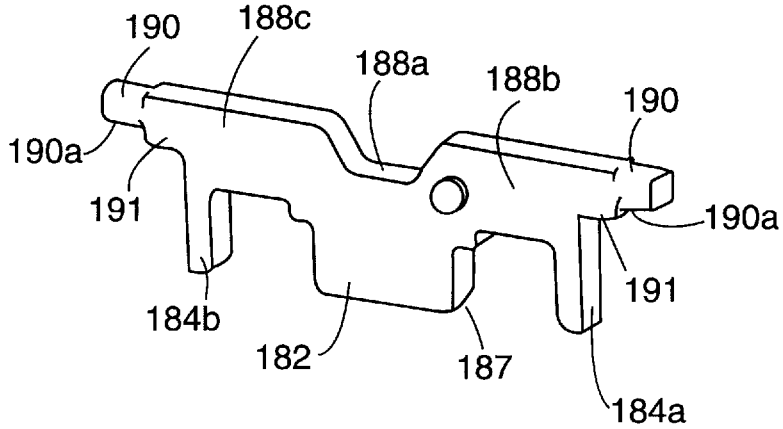
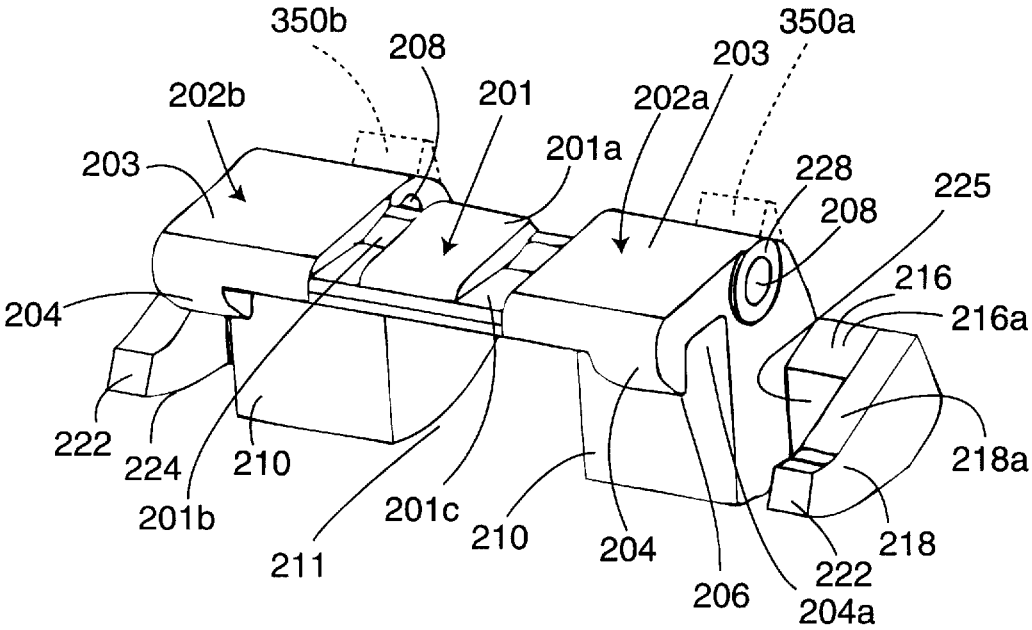
Fig. 5

BUCKLE FOR USE WITH A PRETENSIONER

The present invention is a continuation-in-part of U.S. Ser. No. 09/099,756, filed Jun. 18, 1998, now U.S. Pat. No. 5,996,193.

BACKGROUND AND SUMMARY OF THE INVENTION

The present invention generally relates to buckles for seat belts and more particularly to that type of buckle usable with a buckle pretensioner or belt tightener.

The present invention relates to a new and improved buckle for use with a buckle pretensioner of a safety belt system and one that resists the very high g-forces generated when the pretensioner is activated. As known in the art, these g-forces arise as the pretensioner is rapidly moved to remove belt slack about an occupant. At the end of a pretensioning stroke the buckle frame (typically attached to the pretensioner) is suddenly stopped, however, due to inertia, the button will continue to move relative to the now stopped buckle frame. This movement of the button, unless compensated may cause, in certain situations, the latch plate of the buckle to move out of its locked position, permitting the tongue to unlatch.

An object of the present invention is to overcome the above deficiency in the prior art.

Accordingly, the invention comprises: a seat belt buckle operable with a pretensioner connected thereto for moving the buckle a determinable distance to remove slack of the seat belt about an occupant, the buckle comprising: a frame, adapted to be connected to the pretensioner, defining a tongue receiving opening to receive a tongue as the tongue is moved in a first direction, the frame having a first latch opening therein, and opposing frame sides, each side including a latch plate slot arranged generally perpendicular to the first direction. A weight assembly, pivotably connected to the frame to generate a line contact force upon the top of the latch plate during operation of the pretensioner, forces the latch plate into the latch opening. A manually moveable button is operatively received upon the frame having ramps for lifting the latch plate to its unlatched position. A second embodiment of the invention provides a supplemental button-blocking surface on the weight to interact with the button.

Many other objects and purposes of the invention will be clear from the following detailed description of the drawings.

BRIEF DESCRIPTION OF THE DRAWINGS

In the drawings:

FIGS. 4 and 4*a* show a front plan and side plan view of a latch plate.

FIG. 4*b* is an alternate embodiment of the latch plate.

FIG. 5 is an isolated isometric view of a weight.

DETAILED DESCRIPTION OF THE DRAWINGS

Figure 1:
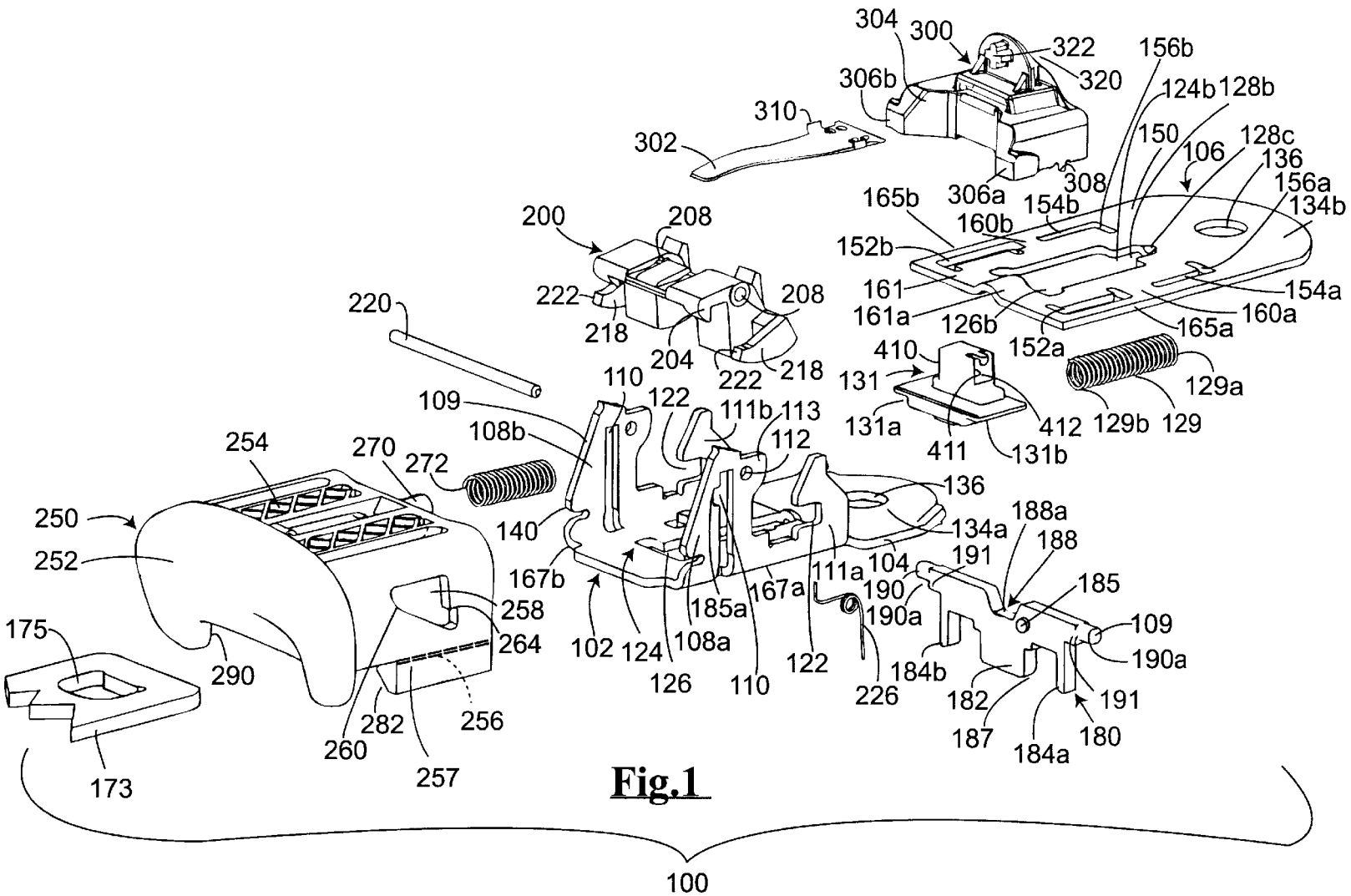
FIG. 1 is an assembly view showing many of the major elements of the present invention.
Figure 2:
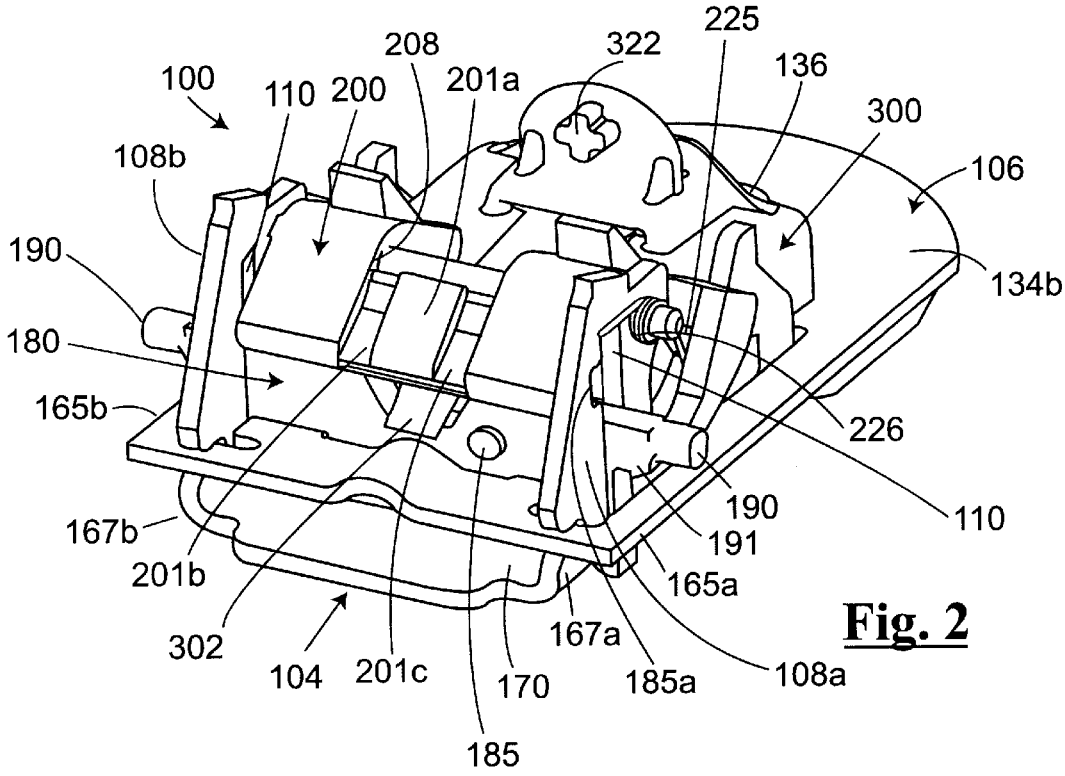
FIG. 2 shows upper and lower frame parts matingly connected with other button parts in their latched condition.

The buckle 100 includes a frame 102 having a lower frame part 104 and an upper frame part 106 which mates with the lower frame part 104. The buckle is covered by a protective hard plastic, hollow cover 342. The lower frame part 104 includes two upraised sides 108*a,b*. Each side 108*a,b* includes a vertical slot 110, which serves as a guide for a vertically movable latch plate 180. Each side further includes a hole (generally round shaped) 112 in an extending lobe portion 113. The forward facing surface 109 of each side 108*a,b* is inclined and terminates in a sharp point 111, which is used to provide an interference fit with the buckle covering. The lower frame part 104 and the upper frame part 106 include a plurality of notches and grooves which permit these two frame parts to be mated together as shown in FIG. 2. With reference again to FIG. 1 and to FIG. 3, the frame part 104 includes a T-shaped slot 124 having a cross-slot (latch opening) 126, which receives a latch portion 182 of the latch plate 180, and an axially extending portion 128. The lower frame part 104 further includes an end piece 134*a* having an optional opening 136. The front of each side 108*a,b* includes a slot 140, which receives and aligns the lower frame part 104 to the upper frame part 106.

The upper frame part 106 is formed from a thin flat plate 150 having two sets of spaced openings 152*a,b* and 154*a,b*, a central opening 124*b* having a narrow extending slot 128*b* and cross slot 126*b*. Slot 128*b*, when in position upon the lower frame part 104, is generally collinear to and spaced above (see space 170) the axially extending slot portion 128 (in the lower frame part 104). One end 129*a* of an ejector spring 129 is sandwiched between the frame parts 104 and 106 (at the narrow end 128*c* of slot 124*b*) and the other or free end 129*b* biases an ejector 131. The ejector 131 is generally rectangular shaped and is also received in the space 170 between the frame parts. Sides 131*a,b* of the ejector 131 are guided fore and aft against the axially extending portion 128*a* of T-shape slot 124*a* of the lower frame 104. The ejector further includes an upstanding projection 410, which defines a hollow chamber 411. A magnet 412 is press fit within the chamber. As related below the magnet 412 activates a reed switch when it is moved to its latched position. The magnet and reed switch are more clearly shown in FIGS. 7 and 8.

Figure 3:
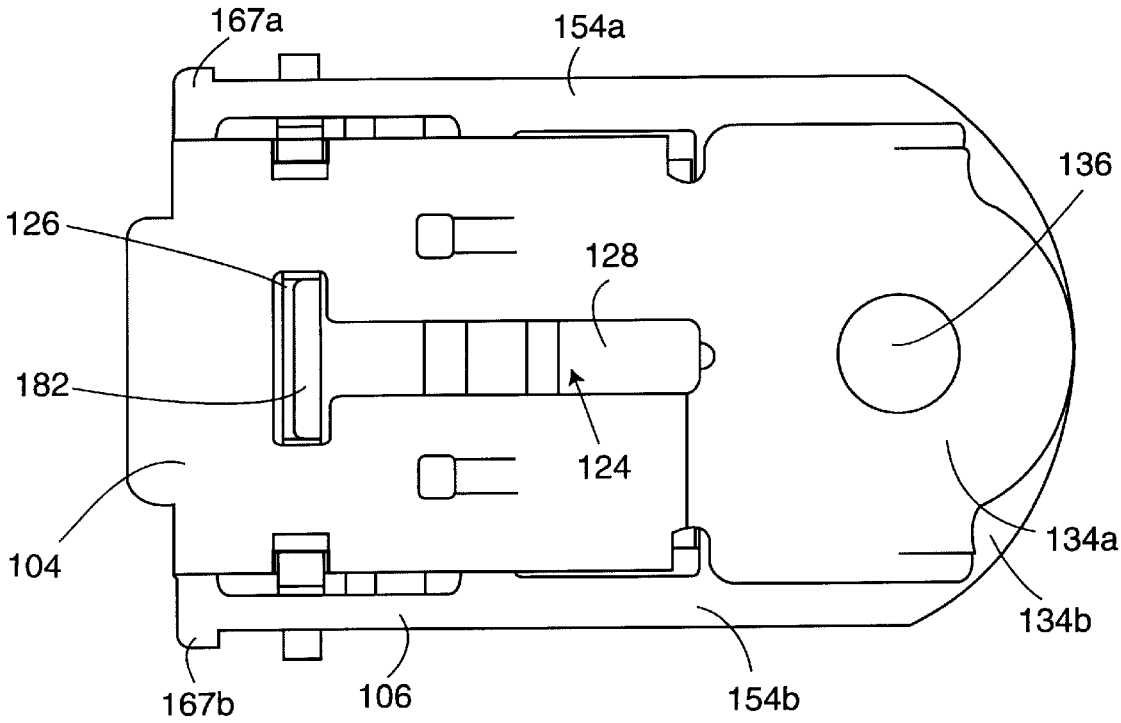
FIG. 3 is a bottom plan view of the buckle.
Figure 4:
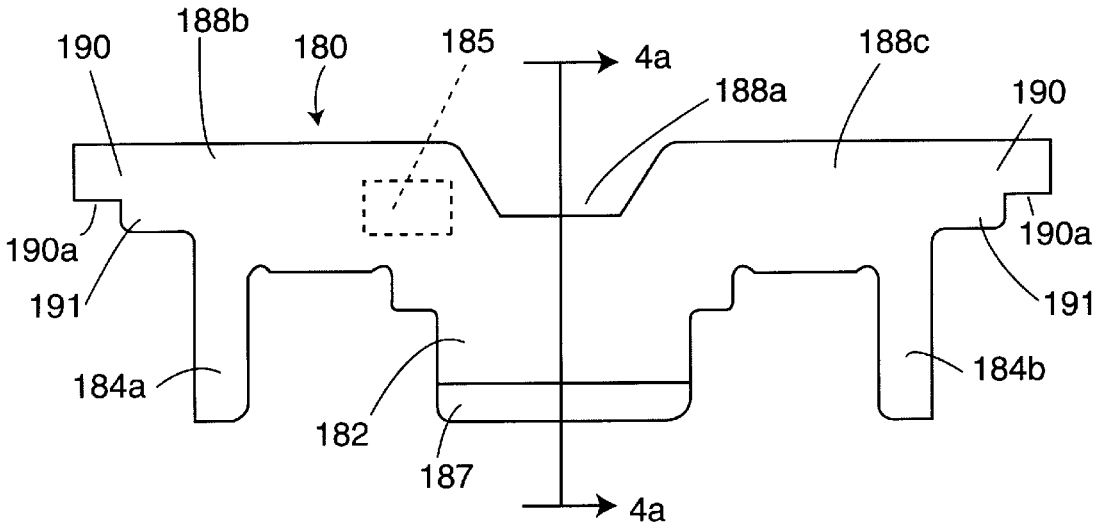

The upper frame part 106 includes an end piece 134*b* having an optional opening 136 of the same size as opening 136 in the lower frame part 104. When the frame parts 104 and 106 are attached, these openings 136 are aligned one to the other. This configuration is shown in FIGS. 2 and 3. A cable or metal strap (see FIG. 7), shown diagrammatically as 332, can be attached (such as being riveted) to the buckle 100 through the end pieces 134*a,b*, in a known manner, typically through the aligned openings 136 and attached to a belt tensioning device, which is also referred to as a pretensioner 330.

The assembly of the lower and upper frame parts is rather conventional and known in the art. The slots 152*a,b* of the upper frame part 106 are received within the slots 140 on the front of the sides 108*a,b* and the upper frame part is then rotated downward so that the sides 108*a,b* extend therethrough. The upper frame part 106 is laid upon the lower frame part 104 with medial portions 160*a* and 160*b* resting upon the top of the opposing slot or groove 116 in each side. The upraised ends 111*a,b* of each respective side 108*a,b* extend through a corresponding opening 154*a,b* respectively. The front 161 of the upper frame part 106 is bent upwardly (see FIGS. 1 and 2) so that when in place on the lower frame part 104 it cooperates to define a slot 170 (see FIG. 2) through which a tongue 173 is received. The sides 165*a,b* of the upper frame plate 106 extend outward over the corresponding sides 167*a,b* of the lower frame part 104. A button 250 is movable on sides 165*a,b*.

Figure 2A:
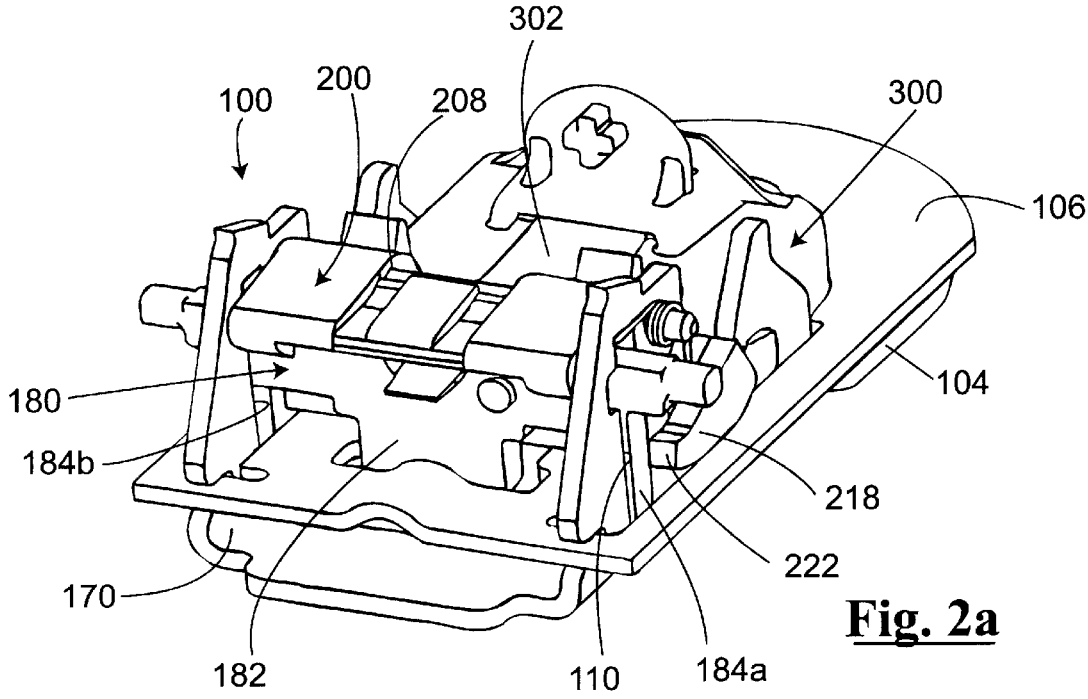
FIG. 2*a* shows the buckle parts in an unlatched condition.

As mentioned, the latch plate 180 is movably situated upon the sides 108*a,b*. The latch plate 180, as shown in FIGS. 1, 2, 2*a*, 4*a* and 4*b*, includes the central latch portion 182 which when in a locked or latched position is received within the slots (latch openings) 126*a*, 126*b* and within a latch receiving opening 175 of the tongue 173. The latch plate also includes two side legs 184*a,b*, which are slidably received and guided in the frame slots 110, and two extending, typically squareshaped ends or wings 190. Each wing 190 includes a downwardly depending extension or member 191. The lower tip 187 (also see FIG. 4*a*) of the central latch portion, which extends through slots 126*a* and 126*b*, may be chamfered or flat as shown in phantom line (see FIG. 4*a*). The latch plate 180 further includes a top 188 having a lowered center portion 188*a*. A leaf spring 302 acts upon the top center portion 188*a* to bias the latch plate 180 downwardly into the slots 126*a*, 126*b* in the frame parts to its latched position (as shown in FIGS. 2 and 2*a*). During assembly the latch plate 180 is first slid into the right side slot 110 and then into the left side slot 110. To insure that the latch plate 180 is facing as illustrated in FIGS. 1 and 2, the latch plate 180 and the lower frame 104 include error proofing features to preclude the latch plate being installed in a reverse or opposite manner. These error proofing features include a projection 185 of the right hand, front facing surface (see FIG. 1) on the latch plate 180 and a complementary groove or keyway 185*a* formed in the right-hand slot 110. The projection can be shaped as a raised cylinder (see FIG. 4*b*) or as a raised square or rectangle (see FIG. 4*c* which is a view from the rear of the latch plate) or another similarly functioning shape. As can be appreciated, if the latch plate 180 is rotated 180° about a vertical axis it would not be possible to install it within the slot 110 as the projection 185 would be blocked upon contacting side wall 108*a*.

Figure 6A:
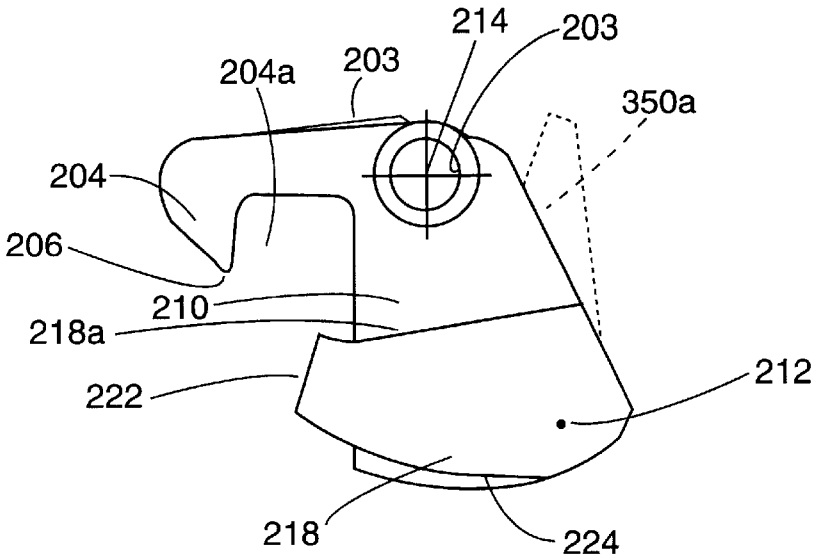
FIGS. 6*a* and 6*b* are respective side plan and front plan views of a weight.
Figure 6B:
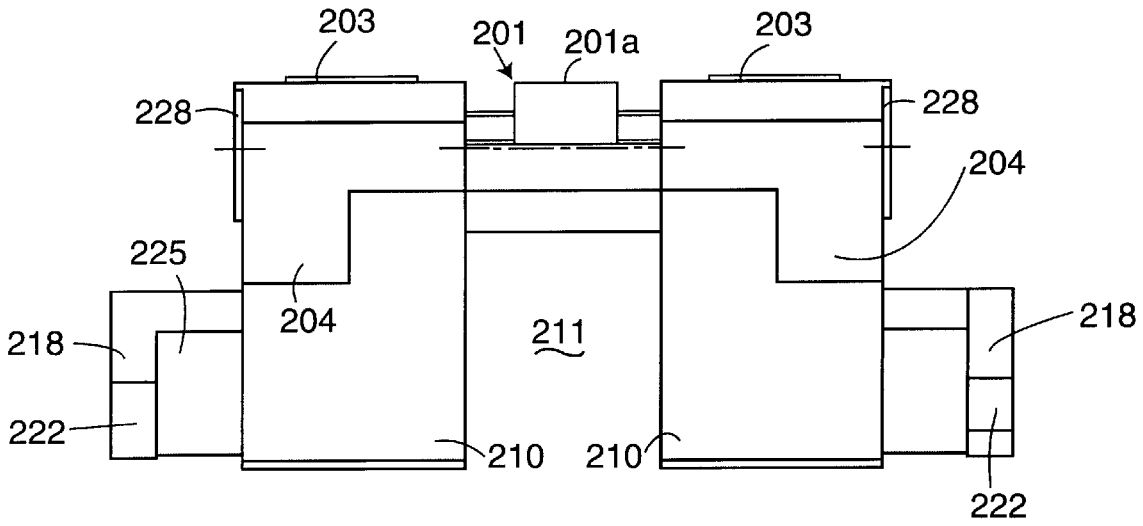
Figure 7:
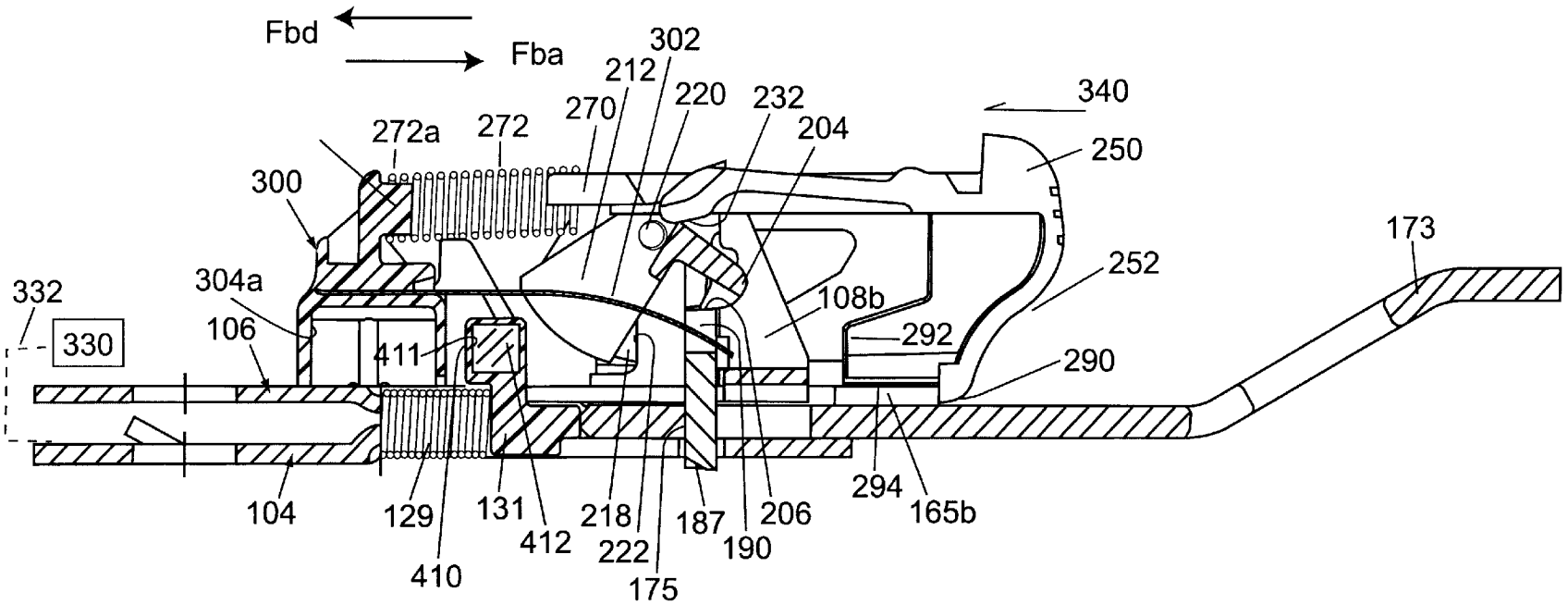
FIG. 7 shows a cross-sectional view of an assembled buckle in its latched configuration with its tongue inserted therein and connected to a pretensioner.
Figure 8:
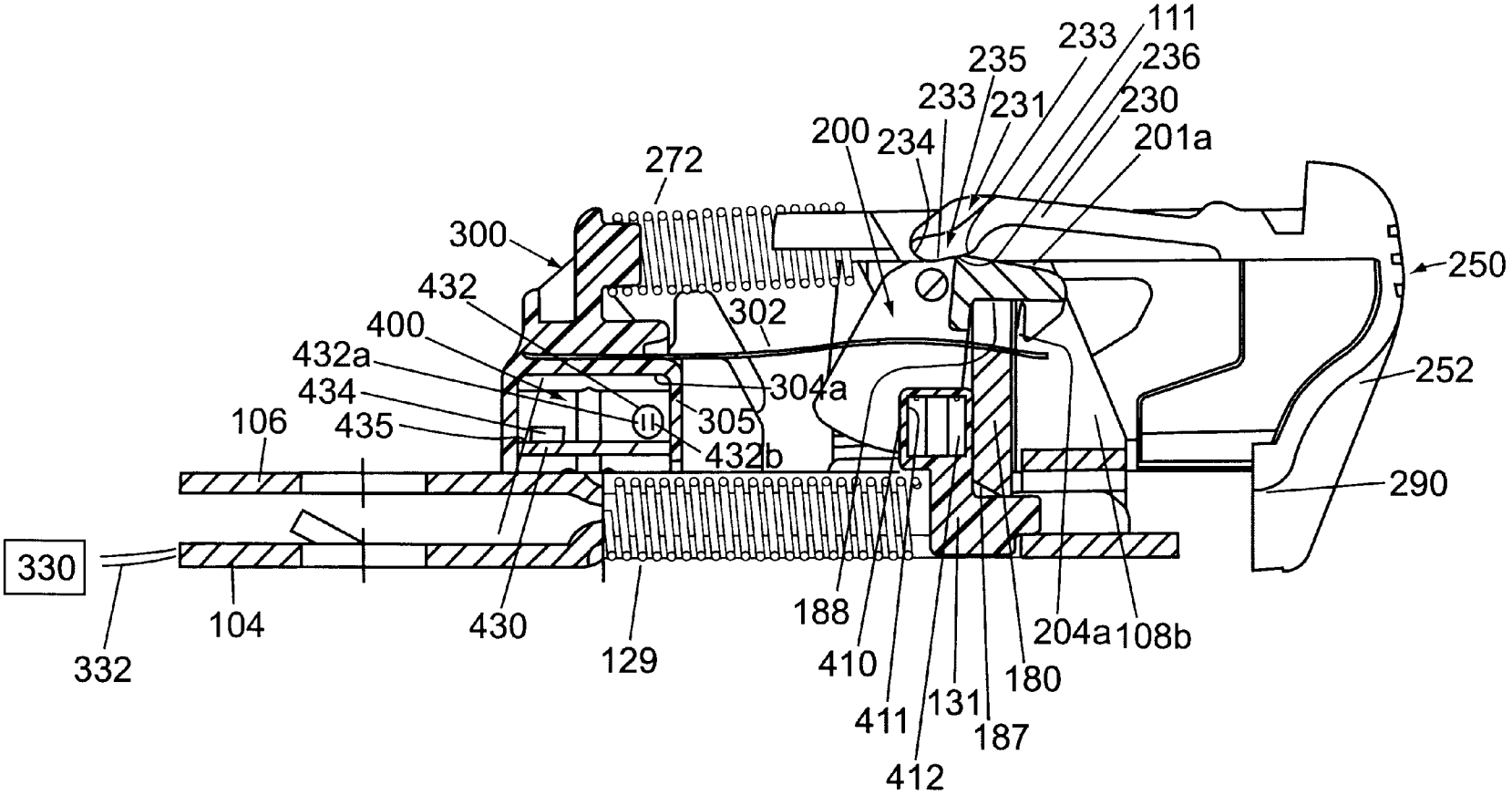
FIG. 8 is a cross-sectional view showing the buckle in its unlatched configuration.

The latch plate 180 operates in conjunction with a weight or inertia mass 200. The weight 200 as shown in FIGS. 5, 6*a* and 6*b* includes a center section 201 and left and right (first and second) segments 202*a,b* which are generally the mirror image of each other. Each segment 202*a* and 202*b* includes a forward extending hook portion 204 (see FIGS. 6*a* and 6*b*) defining a line contact or engagement surface 206, and a bore 208 through which is received the pin 220 (as shown in FIG. 2). Each hook 204 also defines a hooked recess 204*a*. The pin 220 and opposing bores 208 define an axis of rotation 214 (see FIG. 6*a*) of the mass 200. Each segment 202*a,b* of the mass 200 includes a depending lobe 210 which extends below a corresponding bore 208, i.e. the axis of rotation 214, to assist in placing the center of gravity (cg) 212 of the mass 200 below the center of the axis of rotation 214. Each lobe 210 is spaced apart, this spacing shown by numeral 211. Each segment 202*a,b* further includes a laterally extending portion 216 and a forward extending portion 218. The tops 216*a* and 218*a* of the respective portions 216 and 218 (of each segment 202*a,b*) are generally co-planar but recessed below the respective top 203 of each segment 202*a* and 202*b*. Each forward extending portion 218 includes a flat end or tip 222, which during pretensioner operation impacts with a corresponding depending member 191 of the latch. The bottom 224 of each portion 218 is arcuately shaped, the purpose of which is to provide clearance with portions of the push button 250 during rotation of the weight 200. Each portion 218 is spaced from a corresponding, depending lobe 210 to form a slot or groove 225. An optional anti-rattle spring such as torsion spring 226 may be used to bias the weight away from the frame and against the latch plate 180. As shown in FIG. 2, one leg of a torsion spring 226 is received within the top of a slot 110, while the other leg of the spring is received within the groove 225 on the right-hand side of the weight to generate a counter-clockwise bias force on the weight. A second torsion spring may be similarly placed on the other side 108*b* of the frame and operate on the left-hand groove 225 of the weight. The anti-rattle spring may be implemented in a number of ways such as by fabricating one or more plastic, integral leaf spring or spring finger 226*a* (as shown in FIGS. 7, 8 and 9*a*) which extend down from an under surface of the top of the button and bias the weight toward the latch plate 180. Reference is again made to the center section 201. The top center 201*a* of this section 201 is at the level of the adjacent tops 203 of each segment 202*a* and 202*b*. The plastic button spring finger 226*a*, if used, rides on this top center section 201*a*. Side sections 201*b* and 201*c* are recessed below the top of the center section 201*a* (see FIGS. 7 and 8). The spring finger 226*a* includes a flexible arm 230 having a tip 231. The lower surface 232 of the tip 231 contacts the center 201*a* of the weight. The lower surface 232 includes a front portion 233, a rear portion 234 and a center portion 235. The profile of each of the front 233 and rear 234 portions of the lower surface is circular in cross-section. The center 235 of the lower surface is flat and is tangent to the circular profile of the front 233 and rear 234 portions of the lower surface. With the latch plate in its unlatched position, as shown in FIG. 8, the front circular profile 233 rides on the rear edge 236 of the center section 201*a* and urges the weight downwardly onto the latch plate. With the latch plate 180 in its latched position, as shown in FIG. 7, the rear circular profile 234 is in contact with the rear edge 236 and similarly urges the weight downwardly.

Each lobe 210 includes an outward facing circular projection or stand-off 228 which serves to minimize sliding friction between lobe 210 and a corresponding portion of the inner wall 132*a,b* of the frame sides 108*a* and 108*b* respectively. The weight 200 in many of the previous figures is shown with two upwardly extending ears 350*a* and 350*b*. These ears are optional in the preferred embodiment. To emphasize this optional feature the ears are shown in phantom line in FIGS. 5 and 6*a*.

The leaf spring 302, seen in FIG. 1, is supported by and is part of a spring assembly 300. The spring assembly 300 is also shown in FIGS. 7 and 8. The spring assembly 300 includes a body 304 having two small laterally extending, generally cube-like projections 306*a,b*, which are received into a corresponding slot 122 (see FIG. 1) of frame parts 111a and 111b respectively. The body 304 also includes two spaced depending projections 308 (only one of which can be seen in FIG. 1) which extend below the main portion of body 304 and which are received within a corresponding slot 156*a,b* of the top frame part 106. It should be noted that the spring 302 is shown detached from the body 304 in FIG. 1. It is preferred that the body 304 is injection molded about the rear spring end which includes a raised portion or rib 310. While the rear end of the spring can be mechanically connected to the body 304, injection molding provides a number of benefits. These benefits are that the leaf spring 302 is always in the correct location, which prevents cocking of the leaf spring 302, which, in turn, provides an even and consistent distribution of forces on the top 188*a* of the latch plate 180, so that the latch plate 180 will slide up and down without tilting to one side in the vertical slots 110 of lower frame 104. Additionally, the leaf spring 302 will not be damaged during hand assembly or misassembled as may happen if the leaf spring were mechanically secured to the spring body 304. The leaf spring 302 will be at the correct height at all times so the latch plate 180 will have the correct force needed to overcome the frictional force of the ejector 131 on the latch plate 180 and always engage the tongue 173.

Figure 12:
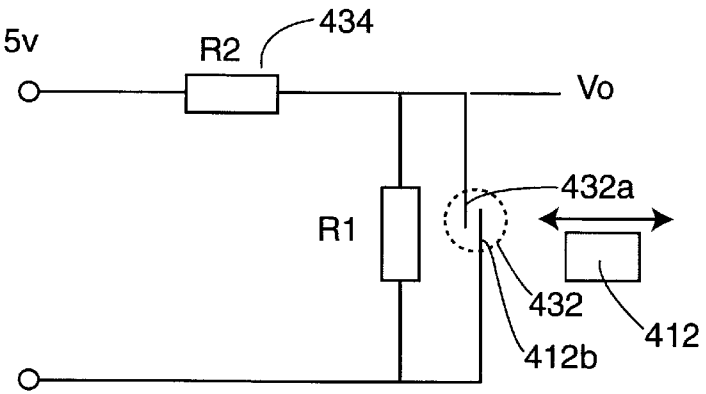
FIG. 12 shows a circuit for a sensor.

The spring body 304 also includes a riser 320 having a boss 322, which receives the end 272*a* of push button spring 272. The body is also hollow and includes a cavity 304*a* into which a buckle-usage sensor such as a reed switch assembly 400 is inserted. The cavity 304*a* and reed switch assembly are more clearly shown in FIGS. 7 and 8. When the tongue 173 is inserted into the buckle 100, the ejector 131 is moved closer to the reed switch assembly and activates same. As can be seen, the inner or front wall 305 of the cavity is thinner than a corresponding outer or rear wall. This beneficially permits the placement of the reed switch closer to the magnet 412. The assembly generates a control signal signifying that the buckle is in its latched position. The assembly 400 includes a circuit board 430 on which a reed switch 432 is mounted. The reed switch includes two relatively movable reeds 432*a,b* shown diagrammatically in FIGS. 8 and 12. The circuit board also supports a control circuit 434, which is further illustrated in FIG. 12. The circuit 434 comprises a simple resistor network with resistor R1 connected in parallel with the reed switch 432. Resistor R2 is connected in series with resistor R1. When the two reeds are connected, resistor R1 is shorted out and the circuit's resistance is equal to R2. With the two reeds spaced apart, the circuit's resistance is equal to the sum of R1 and R2. The reeds 432*a* and 432*b* are normally closed and open as the magnet (carried by the ejector 131) approaches the latched position shown in FIG. 7. The output voltage, $v_o$ or circuit current, I, varies with the state of the reed switch (as measured by the change in output voltage or circuit current, and is communicated to a system controller (not shown), through one or more wires 435, which recognizes that the buckle 100 has been latched, typically about a seated occupant.

During the assembly of the upper and lower frame parts 104 and 106 the latch plate 180 is inserted between the guide slots 110 of the lower frame 104 so that its ends or wings 190 extend laterally from each side 108*a,b* respectively. The spring assembly 300 is secured to the upper frame part 106 so that the spring 302 fits upon the top 188*a* of the latch 180. Also during assembly, the ejector and ejector spring are placed between the frame parts 104 and 106. Thereafter the weight 200 is mounted to the frame 102. With the latch plate 180 in an elevated position within the guide slots 110, the hooks 204 are positioned in front of corresponding front portions 188*c* and 188d of the latch 180 with the forward extending portions 218 positioned below a respective end or wing 190. The weight 200 is manipulated so that its bore(s) 208 are co-linear with the opening 112 in each frame side 108*a,b*. Thereafter the pin 220 is inserted through the openings 112 and bores 208 to secure the weight to the frame 102. The sides 108*a,b* are positioned within a respective one of the slots 225 on either side of the weight 200. If an anti-rattle torsion spring 226 (or springs) is used, it is then secured about the pin 220 and to the frame (in the top of slot 110) and weight (in slot 225). As mentioned earlier, if the button 250 includes the spring finger 226*a*, the torsion spring 226 is eliminated.

As mentioned above, the buckle 100 also includes a button 250. The button 250 is slidably received upon the frame 102. The button 250 includes an end 252, which is depressed (by its user) to release the tongue 173 from the buckle 100, a top 254 and extending sides 256. A partial lower portion 256*a* (see FIG. 9*a*) of each side 256 of the button 250 includes an opposingly situated axial slot (or recess) 257 which receives and slides upon a corresponding extending side 165*a* or 165*b* of the upper frame part 106. The bottom of each lower side portion 256*a* is designated by numeral 280. Each bottom 280 includes a chamfer 282, which facilitates the assembly of the button to the frame. Each button side 256 additionally includes an opening, slot or recess 258 therein, one portion of which is formed as a ramp 260 which engages a lower surface 190*a* of a corresponding end or wing 190 and lifts same. A second portion of the slot (or recess) 258 is formed as a notch or horizontal guide 264 and is positioned over the ends 190 of the latch plate 180 to prevent the latch plate from lifting or being lifted out of the latch opening or slots 126*a* and 126*b* in the lower and upper frame parts and tongue slot 175. As also shown in FIG. 9*a*, each side 256 of the buckle 250 further includes a respective ramp 284, which also facilitates the assembly of the button to the frame. The button is attached to the frame as follows. The latch plate 180 is moved to its unlatched portion in which the wings 190 are raised relative to the sides 165*a* and 165*b* of the upper frame part 106. One of the wings 190, such as the right-hand wing, is positioned against a corresponding ramp 284, on the right side of the button. The left-hand wing 190 is held against the end of the left side of the button. With the parts as identified, the left-hand wing will extend slightly beyond the left side of the button. Thereafter, the left side of the button is bent outwardly. This bending permits the left-hand wing 190 to rest on the left-hand ramp 284. The button is then pushed onto the frame until the wings 190 slide into a respective notch 264. In this configuration, sides 165*a* and 165*b*, of the upper frame part 106, will be positioned at the mouth of a respective ramp or chamfer 282 on each side of the button. Thereafter, each side 165*a* of the upper frame part 106 is pushed against a chamfer 284. A continued pressure snaps the side 165*a* into a corresponding slot 257. Side 165*b* is snapped into the button in the same manner.

Figure 9:
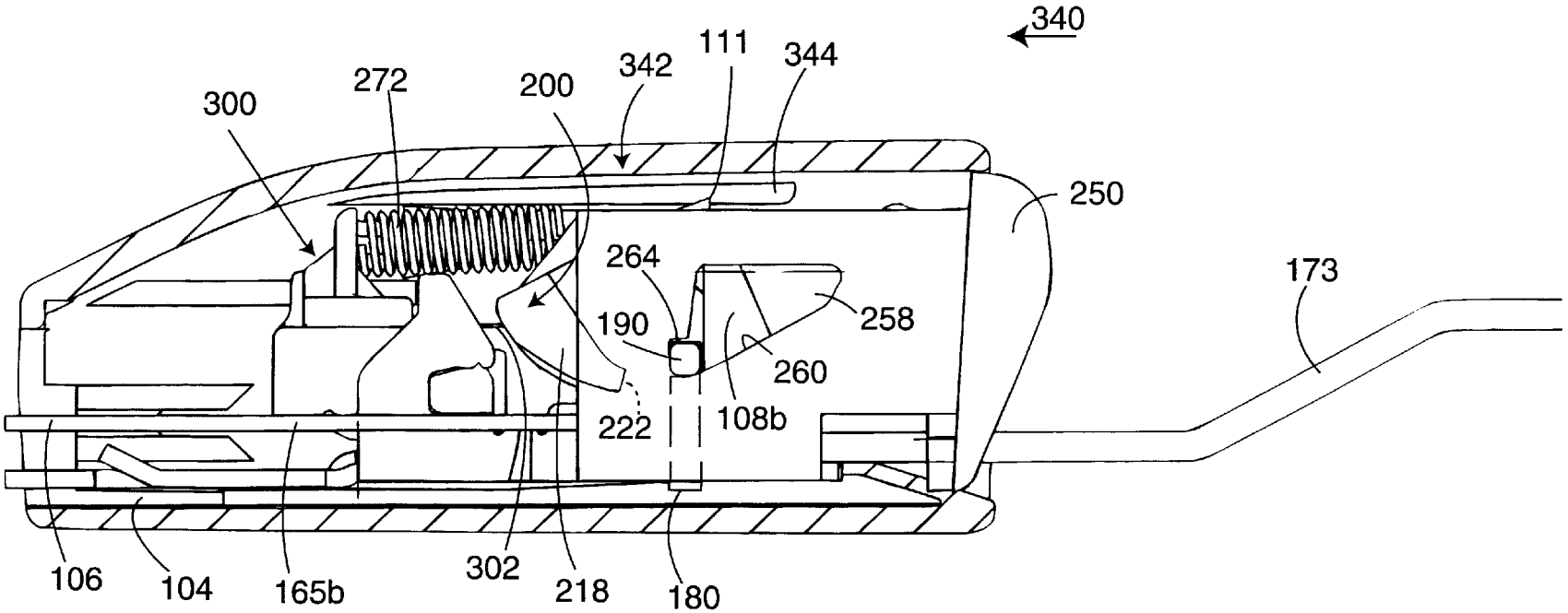
FIG. 9 is a side plan view of the buckle in a latched condition, showing a button in relation to other components of the buckle.
Figure 9A:
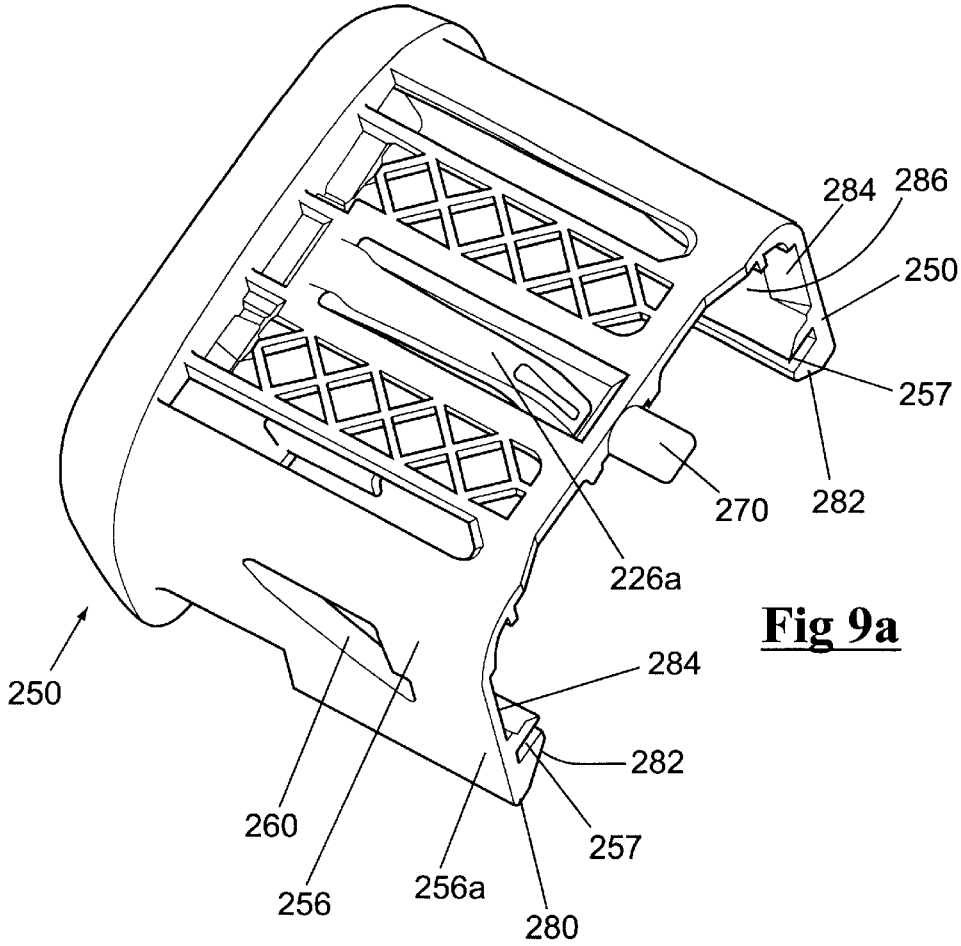
FIG. 9*a* is a rear isometric view of a button.
Figure 9B:
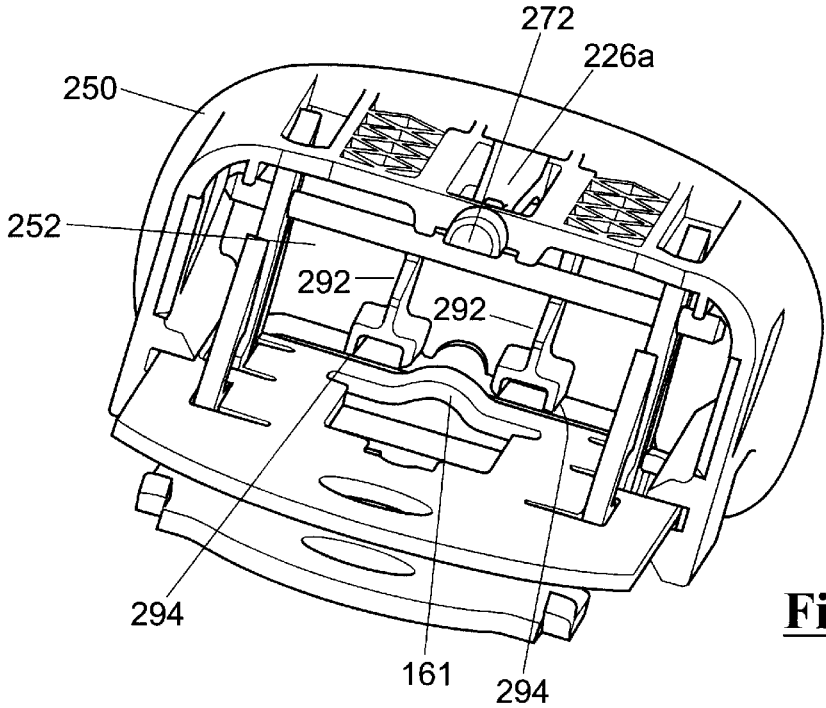
FIG. 9*b* is a rear isometric view of the buckle frame with button attached; the latch plate has been eliminated from this view.
Figure 9C:
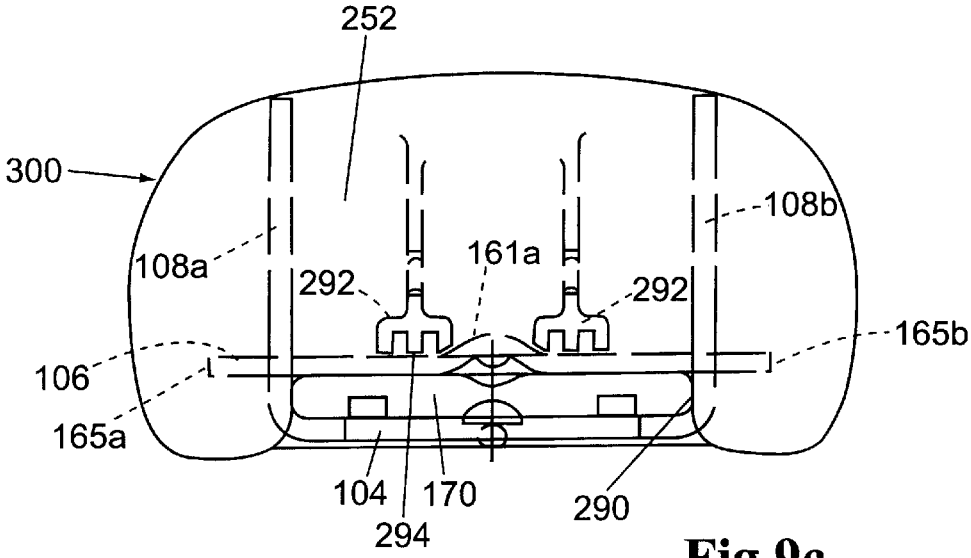
FIG. 9*c* is a front plan view of the buckle showing the top end of the button and a portion of the frame.

Reference is briefly made to FIGS. 9*b* and 9*c*. FIG. 9*c* is a front-end view showing the push end 252 of the button in relation to the frame. Only a portion of the lower frame 104 is visible. This view also shows that the end 252 of the button includes a recess or notch 290. With the button mounted on the frame, the notch 290 is in alignment with the tongue-receiving opening or slot 170. As can be appreciated from the various figures, the button 250 is hollow. The interior surface 252*a* (opposite to end 252) includes two projecting members 292. Each member 292 includes a lower surface 294, the lower end of which is closely spaced to the front 161 of the upper frame part 106 to prevent the tongue 173 from being inserted into the hollow interior of the button. The members 292 are located on each side of the bent portion 161*a* of the upper frame part 106. As illustrated, the lower surface 294 is notched (one notch in FIG. 9*c*, two notches in FIG. 9*b*, for example). The surface 294 will generally conform to the profile of the first end 161 of the upper frame part 106.

The top 254 of the button further includes a pin formation 270, which extends into a button bias spring 272. As can be seen from FIGS. 1, 7, 8 and 9, the end 272*b* of spring 272 is received upon and supported by the pin 270. The other end 272*a* of spring 272 is received upon the boss 322 of riser 320 of the spring assembly 300. The riser 320 provides a reaction surface for the bias spring 272.

Returning briefly to FIG. 8, this figure is a cross-sectional view illustrating the buckle 100 in its unlatched position and also shows the spring finger 226*a* acting on surface 201*a* of the weight 200. In this figure, the latch plate 180 was previously lifted upwardly by the ramps 260 of the button 250 to place the latch in the position illustrated. More specifically, as the button was pushed in, the opposing ramps 260 engaged the bottom 190*a* of each end or wing 190 and lifted same to its unlatched or elevated position. As the latch plate 180 is urged upwardly, this motion pushes each wing 204 upwardly causing the weight to pivot about the pin 220 (in a counter-clockwise manner as seen in FIG. 8) against the bias force of the spring 226*a*. This rotation moves the wings 204 off of the top 188 of the latch plate 180 and permits the latch plate to become positioned within the groove or pocket 204*a* of each wing 204. Additionally, with the latch plate 180 in its elevated position, the ejector bias spring 129 has moved the ejector 131 forward such that it rests below and supports the tip end 187 of the latch plate 180.

FIG. 9 also shows the buckle in its latched condition (which is similarly shown in FIG. 7). To release the tongue 173 the button 250 is depressed (see direction of arrow 340). As the button is pushed to the right, the horizontal notch guide 264 over-travels the ends 190 of the latch plate 180 and the ramps 260 (on each side of the button 250) and after moving a short distance lifts the weight 200 and latch plate 180 upwards out of the slots 126*a,b* in the frame parts and the slot 175 in the tongue 173. Thereafter, the ejector 131 ejects the tongue from the buckle 100. Also as the button is pushed inwardly, the lower surfaces 294 slide over the front 161 of the upper frame part 106. FIG. 9 also shows the buckle parts enveloped by a single piece cover 342. The upper side of the top of the cover 342 includes two ribs 344 (only one is shown in FIG. 9). As the cover is slid about the frame, the tips 111 bite into a respective rib 344 to insure that the cover is securely retained to the frame.

Reference is again briefly made to FIGS. 7 and 9, which show many of the buckle parts in their respective positions with the tongue 173 latched in place. When the tongue 173 is inserted within the buckle, it engages the ejector 131 and moves it rearward permitting the spring 302 to urge the latch plate 180 downwardly into the openings 126*a* and 126*b* in the frame 102 and in the opening 175 in the tongue 173. As the latch plate 180 moves downward in the frame, the constant torque exerted on the latch plate 180 by the springs 226 or 226*a* causes the weight 200 to rotate about pin 220. With the latch plate 180 in its latched position, the engagement wings 204 of the weight 200 will be rotated to a position upon the top 188 of the latch plate with the engagement surface 206 on the top of the latch plate. Additionally, with the latch plate in the above position, the end face 222 of each arm 218 will be positioned slightly behind each corresponding depending member 191. FIGS. 7 and 8 further illustrate the interaction of the button spring finger 226*a* on the weight 200. In FIG. 8, the curved under-tip 232 rests on the top center portion 201*a* of the weight 200 keeping the weight 200 in contact with the latch plate while the buckle is unlatched. As the tongue is inserted into the buckle and as the latch plate is forced into its latched position, the tip 231 applies a force to the top center portion 201*a* of the weight causing it to rotate. The spring finger continues to urge the wings 204 against the latch plate, which continues to reduce vibration.

The following describes the operation of the buckle 100 during pretensioner operation. Upon sensing a crash, the vehicle's electronic control unit (not shown) generates a signal to activate the pretensioner 330. A typical, pyrotechnic pretensioner of known construction includes a tube with a moveable piston therein. The piston is connected to the buckle ends 134*a,b* via a cable 332 (see FIG. 7) initially accelerating the buckle in the direction of arrow 340. As the buckle is accelerated the frame parts move to the left (in FIG. 7) and the button 250 moves relatively to the right and is stopped by interaction with the ends or wings 190 of latch plate 180. During this very short time period the weight 200 tends to pivot in a counter-clockwise manner about the rod or pin 220 (the center of gravity of the weights is shown by numeral 212). The tendency of the weight 200 to move is stopped by the interaction of the end surface 222 of the weight 200 with the depending member 191 of the latch plate 180. As can be appreciated, this interaction generates a predominately horizontal force on the latch plate 180 and consequently there should be no or at least a very small component of force acting to lift the latch plate. However, any tendency of the latch plate 180 to be lifted by the rotation of the weight will be stopped by the guide 264. The guide 264 is therefore optional in the present design. The inertial force acting on the button, during this accelerative phase, is shown as $F_{BA}$.

Within 3–15 milliseconds of the activation of the pretensioner 330, the downward motion (motion to the left as seen in FIG. 7) of the buckle frame is rapidly decelerated as the buckle frame stops at the end of the travel of the pretensioner 330, typically about 80 mm. The button 250, which will move with the frame 102, will tend to stay in motion even after the buckle frame parts are rapidly stopped. The inertial force acting on the button, during this decelerative phase, is shown as $F_{BD}$. During this decelerative phase of operation of the buckle 100, the weight 200 (due to the placement of its center of gravity 212) will tend to rotate clockwise. In the latched position of FIG. 7 the engagement surface 206 of each engagement hook 204 rests upon the top of the latch plate 180. The curvature of the hooks 204 in relationship to the flat profile of the top of the latch plate 180 provides for a line contact between each hook 204 and a respective mating portion of the latch plate 180. In this configuration the latch plate 180, and more particularly the center portion 182, is positioned within the various latch openings 126*a,b* and 173 in the frame and in the tongue. This configuration prevents the weight 200 from rotating in a clockwise direction. However, as mentioned above, in response to the decelerative forces' input to the weight 200, the weight will attempt to rotate in a clockwise direction thereby urging the hooks with greater force onto the latch plate 180. During this decelerative phase the button 250 will also tend to travel to the left (see FIG. 7) and try to lift the latch plate out of the various slots. This motion is resisted by the inertial forces imparted to the latch plate 180 by the weight. To insure that the button 250 does not lift the latch plate 180 out of the various slots, the resultant force (or torque) generated by the weights must be greater than the force imparted by the button 250 to the latch plate.

Figure 10:
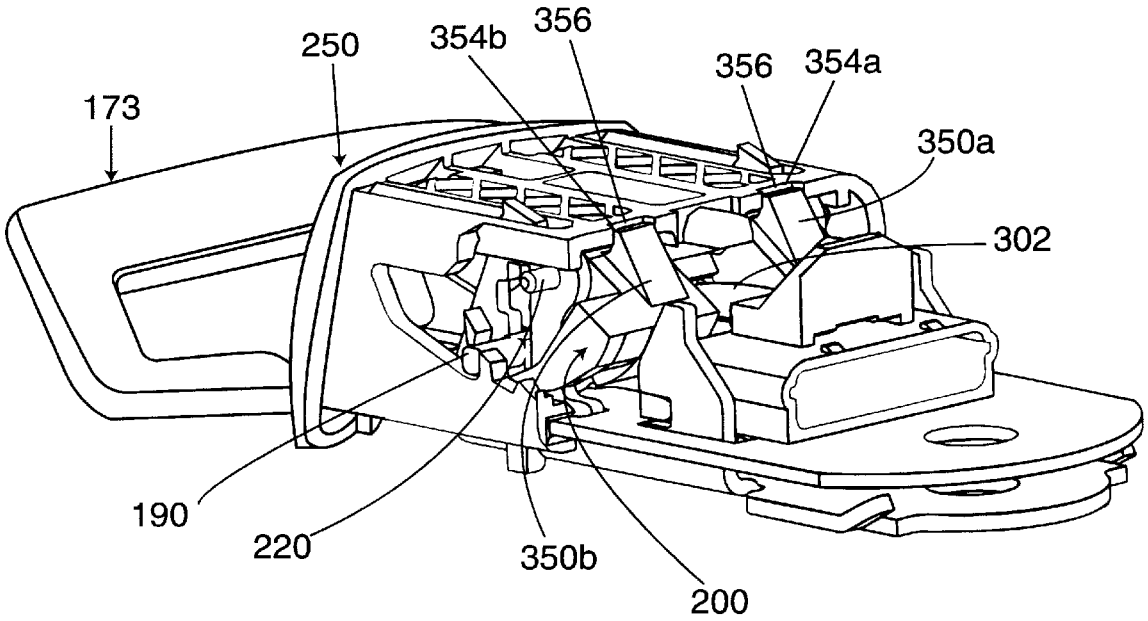
FIG. 10 shows an isometric view of an alternate embodiment of the invention showing a buckle including its frame and button, with part of the button removed.
Figure 11:
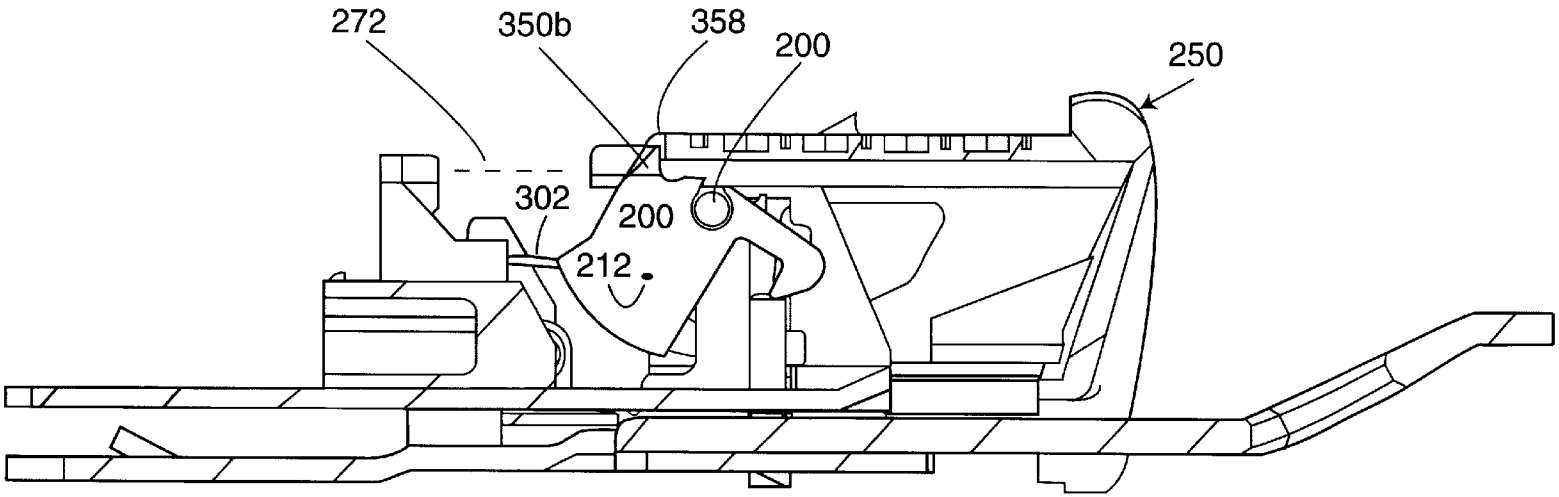
FIG. 11 is a side cross-sectional view generally taken to show the relationship of the ears or projections of this embodiment to the button.

Reference is briefly made to FIGS. 10 and 11, which describe in detail the use of the optional ears 352*a* and 354*b* as part of an alternate embodiment of the invention. As can be seen, the latch plate 180 is positioned through the openings in the upper and lower frame parts. The front face 352 of each of the ears 350*a,b* is flat. With the buckle 100 in its latched condition, the front face 352 of each projection 350*a,b* is oriented generally vertical and spaced (the space is shown by numeral 358 and is about 1 millimeter wide) from the base 356 of each notch 354*a,b*. As will be recalled, the button 250 is biased by spring 272 towards the top of the buckle, that is away from the projections 350*a,b*. As will be seen, the base 256 of each notch 354*a,b* serves as a reaction surface, as such, it is not necessary to use an actual notch so long as a reaction surface is provided. As can be appreciated, the end face across the rear of the button 250, at a location of the bases 356, can be made flat thereby eliminating the notched contour.

The operation of this embodiment is basically identical to that of the buckle shown in FIG. 1. If, however, the inertial force or torque generated by the weight 200 on the latch plate 180 is not sufficient to counter the lifting force created by button on the underside of the wings 190 of the latch plate, the latch plate 180 will begin to rise as it reacts with the ramps 260 and the button will also move to the right as shown in FIG. 11. This slight added movement of the button 250 will place the base 356 in direct contact with the front face 352 of each of the projections 350*a,b* of the weight 200. (Because of the interdependence of the weight 200, due to the location of the engagement surface 206 with the top of the latch plate 180, the weight 200 will have been rotated slightly due to the upward motion of the latch plate). As can be seen from FIG. 11, the moment arm from the pin 220 to each ear 350*a,b* is less than the corresponding moment arm from the pin 220 to the cg 212. Consequently, the inertial forces that are generated by the button at the ears 350*a,b* will be less than those generated by the cg 212 about the pin 220, which are sufficient to prevent or block any further movement of the button during pretensioner firing. During the normal operation of the buckle, that is, during unlatching of the tongue 173 from the buckle, the ears or projections 350*a,b* are pushed backward by the advancing base or reaction surface 356 of the button 250 to rotate the weight 200. Additionally, as the button is moved inwardly the ramps 260 lift the latch plate 180 which in turn lifts the weight 200 at the wings 190 and rotates the weight.

Many changes and modifications in the abovedescribed embodiment of the invention can, of course, be carried out without departing from the scope thereof. Accordingly, that scope is intended to be limited only by the scope of the appended claims.

What is claimed is:

1. A seat belt buckle (100) operable with a pretensioner (330) for rapidly moving the buckle in a first direction a determinable distance to remove belt slack about an occupant, the buckle comprising:

a frame (102), adapted to be connected to the pretensioner (330), having a tongue receiving opening (170) to receive a tongue (173), the frame having at least a first latch opening (126*a*) therein and the tongue including a second latch opening (175), and opposing frame sides (108*a,b*), each side including a latch plate slot (110) arranged generally perpendicular to the first direction;

a latch plate (180), having side portions (184) guidably movable within the latch plate slots (110), the latch plate includes two oppositely extending wings, each wing having a depending extension (191), the latch plate moveable between a latched position within the first latch opening (126*a*) in the frame and within the second latch opening (173) of the tongue and an unlatched position out of the latch and tongue openings;

a pivoted weight (200) rotatable relative to the frame (102) and movable with the latch plate, the weight positioned upon a top portion of the latch plate when the latch plate is in its latched position; the weight (200) generating a force upon the latch plate during operation of the pretensioner tending to keep the latch plate in the first latch opening in opposition to forces generated by a button (250) acting on the latch plate as the button is moved toward the latch plate due to inertial forces which would be produced by operation of the pretensioner, wherein the weight further includes opposing winds (218) which are arranged relative to the depending extensions of the latch plate which swing into contact with these depending extensions, wherein the line of contact between the wings and the depending extensions is generally horizontal so as not to create forces tending to raise the latch plate relative to the frame and the button (250) being operatively received upon the frame and having lifting means (260) acting upon the wings of the latch plate for lifting the latch plate from its latched position to its unlatched position.

2. The buckle (100) as defined in claim 1 wherein the weight (200) includes at least one hook (204) which is positioned atop the latch plate (180) when in the latched position, the hook (204) including an arcuate engagement surface (206) which cooperates with a top portion of the latch plate (180) to provide a line force contact therebetween.

3. The buckle (100) as defined in claim 2 including two hooks (204) spaced from one another, each hook having an engagement surface (206) acting upon respective portions of the latch plate (180).

4. The buckle (100) as defined in claim 2 wherein each hook (204) defines a groove or pocket (204*a*) into which a respective top flat portion of the latch plate is received when in its unlatched position.

5. The buckle as defined in claim 1 wherein the button includes an integrally formed resilient finger which imposes a bias force to a top portion of the weight tending to prevent the weight from rattling.

6. The buckle as defined in claim 5 wherein the resilient finger includes a flexible arm (230) having a tip (231), wherein a lower surface (232) of the tip (231) contacts a center top portion of the weight.

7. The buckle as defined in claim 6 wherein the lower surface (232) of the finger includes a front portion (233), a rear portion (234) and a center portion (235), the profile of each of the front (233) and rear (234) portions is circular in cross-section, the center portion (235) of the lower surface is flat and is tangent to the circular profile of the front (233) and rear (234) portions of the lower surface.

8. The buckle as defined in claim 1 including an ejector reciprocatively movable along the first direction in response to movement of the tongue and an opposing bias spring.

9. The buckle as defined in claim 8 further including a spring housing assembly including a cooperatively molded spring and spring housing, wherein the spring housing is hollow for receipt of a buckle usage sensor responsive to the relative placement of the magnet on the elector.

10. The buckle as defined in claim 9 including circuit means cooperating with the usage sensor to generate a signal indicative of a latched tongue within the buckle, including a resistor network comprising a first resistor (R1) connected in parallel with a reed switch (432) having first and second reeds, a second resistor R2 connected in series with the first resistor R1, wherein when the first and second reeds are connected, resistor R1 is shorted out and the resistance of the circuit means is equal to R2 and with the two reeds spaced apart, the resistance of the circuit means is equal to the sum of R1 and R2, wherein the reeds are normally closed but opened by magnetic forces of the magnet, as the ejector (131), approaches its latched position.

11. The buckle as defined in claim 1 wherein ends of the weight each include an integrally formed facing circular projection or stand-off which serves to minimize, relative-sliding friction between the weight and a cooperating portion of an inner wall (132*a,b*) of the frame sides (108*a* and 108*b* respectively.

12. The buckle as defined in claim 1 wherein the button includes opposing side walls situated generally parallel to the corresponding sides of the frame, wherein the undersurface of each button side wall includes a chamfer which runs parallel to a longitudinal axis of the frame and the chamfer is angled, wherein the angle of the chamfer, as seen in cross-section, is inwardly facing.

13. The buckle as defined in claim 12 wherein each side wall includes an end surface and wherein each end surface includes a chamfer tapering toward a center of the button.

14. The buckle as defined in claim 1 wherein the button includes projections within a hollow interior of the button which provide guide surfaces for preventing the tongue from moving out of its preferred path during insertion into the button.

* * * * *